US005552874A

United States Patent [19]

Ohtsuka et al.

[11] Patent Number: 5,552,874

[45] Date of Patent: Sep. 3, 1996

[54] IMAGE FIXING APPARATUS

[75] Inventors: Yasumasa Ohtsuka, Yokohama; Yohji Tomoyuki, Ichikawa; Akira Hayakawa, Tokyo; Manabu Takano, Tokyo; Daizo Fukuzawa, Tokyo; Atsuyoshi Abe, Yokohama, all of Japan

[73] Assignee: Canon Kabushiki Kaisha, Tokyo, Japan

[21] Appl. No.: 234,943

[22] Filed: Apr. 28, 1994

[30] Foreign Application Priority Data

Apr. 28, 1993 [JP] Japan ..... 5-102736

[51] Int. Cl.[6] ..... G03G 15/20

[52] U.S. Cl. ..... 355/285; 355/208; 355/289; 219/216

[58] Field of Search ..... 355/285, 289, 355/290, 208; 219/216; 359/282

[56] References Cited

U.S. PATENT DOCUMENTS

| | | | |
|---|---|---|---|
| 4,595,279 | 6/1986 | Kuru et al. . | |
| 4,719,489 | 1/1988 | Ohkubo et al. . | |
| 4,914,476 | 4/1990 | Nishitsuji et al. | 355/208 |
| 5,148,226 | 9/1992 | Setoriyama et al. | 355/290 |
| 5,241,349 | 8/1993 | Nagasaka | 355/285 |
| 5,266,774 | 11/1993 | Kimura et al. . | |
| 5,289,247 | 2/1994 | Takano et al. . | |

FOREIGN PATENT DOCUMENTS

| | | |
|---|---|---|
| 0041050 | 3/1985 | Japan . |
| 0149684 | 6/1988 | Japan . |
| 0184777 | 7/1988 | Japan . |
| 0010264 | 1/1991 | Japan . |
| 0006045 | 1/1993 | Japan . |
| 0006043 | 1/1993 | Japan . |
| 0002299 | 1/1993 | Japan . |

*Primary Examiner*—Matthew S. Smith

*Attorney, Agent, or Firm*—Fitzpatrick, Cella, Harper & Scinto

[57] ABSTRACT

An image fixing apparatus includes a heating member for heating an unfixed image carried on a recording material; a fixing temperature controller for providing a variable fixing temperature of the heating member; wherein when the fixing temperature is lowered, an interval of recording material supply to the heating member is increased.

21 Claims, 7 Drawing Sheets

| TEMP. BEFORE OP. $T_1$ | CONT. TEMP. $T_c$ |
|---|---|
| ≧70°C | 170°C |
| ≧50°C, <70°C | 180°C |
| <50°C | 190°C |

IMAGE FIXING APPARATUS

FIELD OF THE INVENTION AND RELATED ART

The present invention relates to an image fixing apparatus for heat-fixing an image on a recording material, more particularly to an image fixing apparatus in which a fixing temperature is changeable.

Conventionally, as image fixing system for fixing a toner image on a recording material, a heat roller type as shown in FIG. 11 is widely used. In this system, a fixing roller 9 having a heat resistive parting layer of PFA or the like on a core metal of aluminum or the like is heated by a heater 10 from the inside. The temperature is sensed by a temperature sensing element 13 in contact with the surface of the fixing roller. Using an unshown control circuit, the heater 10 is on-off controlled to maintain a predetermined temperature. A sheet of paper P carrying a toner image T is passed through a nip formed between the fixing roller 9 and a pressing roller 2 press-contacted thereto, and the toner image is fused and fixed.

However, in this system, the time is required for the heat of the heater 10 reaches to the surface of the fixing roller, and therefore, the high temperature has to be maintained during non-operation period.

A new fixing device has been proposed in which use is made with a very low thermal capacity heater exhibiting very quick temperature rise, and a film in sliding contact with the heater. With this apparatus, the warming up time period can be reduced or eliminated, thus the power consumption during the stand-by state can be removed or reduced very much.

In the apparatus in which the high temperature control is not effected during the stand-by period, the warming state of the apparatus at the time of the start of the fixing operation significantly influences the fixing performance. It is possible that the toner is too much fused with the result of high temperature offset, or insufficient fixing occurs due to insufficiency of heat.

U.S. Pat. No. 5,265,774 has proposed to change the fixing temperature in accordance with the temperature of the apparatus.

During the fixing operation, the recording material takes up the heat in the sheet passage region, whereas in the non-passage region, the heat is not transferred to the recording material, and therefore, the temperature difference between the heat passage region and the sheet non-passage region becomes significant depending on the temperature of the apparatus.

In the apparatus using the film as described above, if the temperature difference between the sheet passage region and the sheet non-passage region becomes large, the force balance of the film is disturbed with the result of incapability of the lateral shift control, or the film is damaged by the lateral shifting force.

SUMMARY OF THE INVENTION

Accordingly, it is a principal object of the present invention to provide an image fixing apparatus in which the temperature difference between the sheet passage region and the sheet non-passage region is reduced.

It is another object of the present invention to provide an image fixing apparatus in which the sheet feeding interval is increased when the fixing temperature is low.

It is a further object of the present invention to provide an image fixing apparatus in which small size recording materials are continuously fixed, the fixing temperature is lowered at a certain point during the continuous fixing operation.

It is a further object of the present invention to provide an image fixing apparatus in which when small size recording materials are continuously fixed, the sheet feeding interval is increased at a certain point during the continuous fixing operation.

It is yet further object of the present invention to provide an image fixing apparatus in which recording materials are continuously fixed, the fixing temperature and the recording material feeding interval is changed at a certain point during the continuous fixing.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
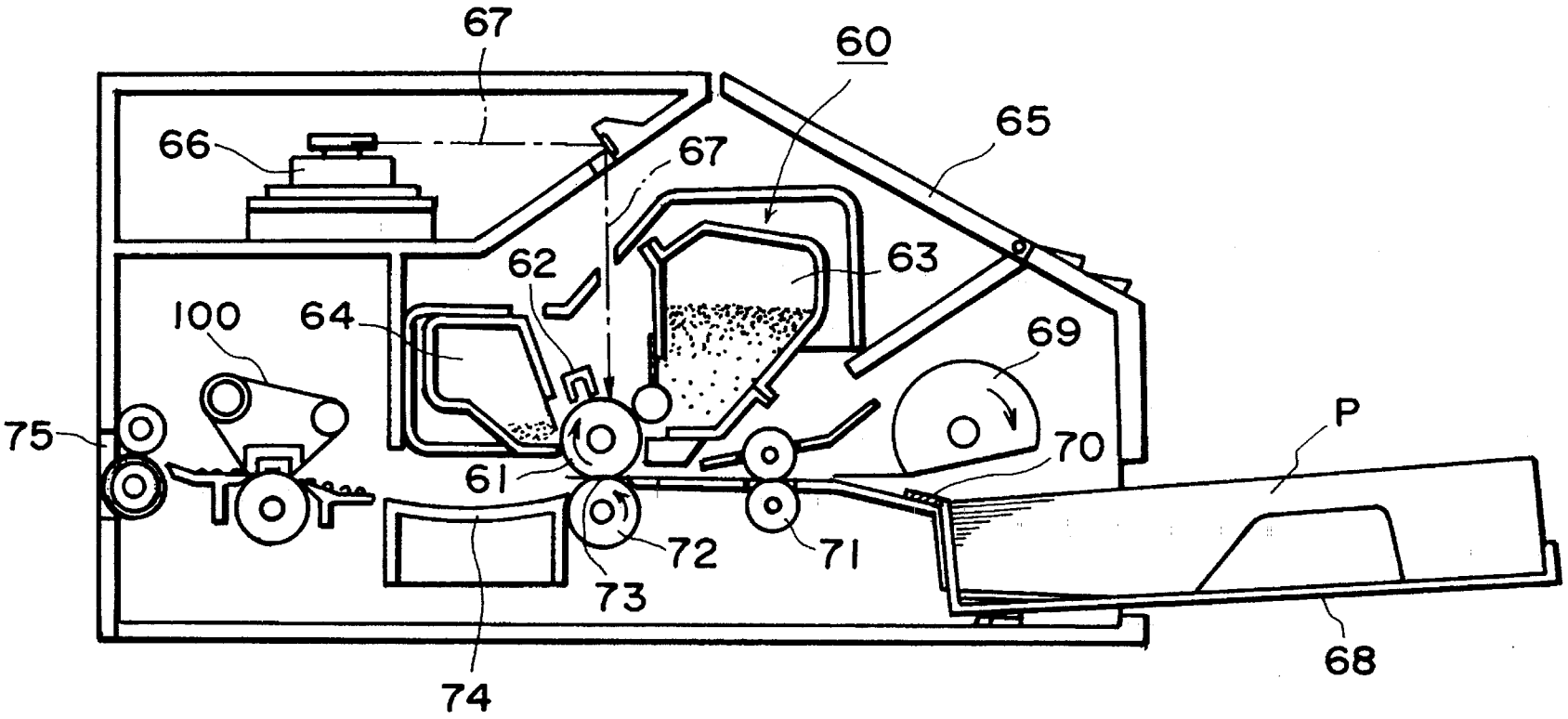
FIG. 1 is a sectional view of an image forming apparatus using an image fixing apparatus according to an embodiment of the present invention.

Referring to the accompanying drawings, the embodiment of the present invention will be described, FIG. 1 is a sectional view of an image forming apparatus according to an embodiment of the present invention.

Figures 2, 3:
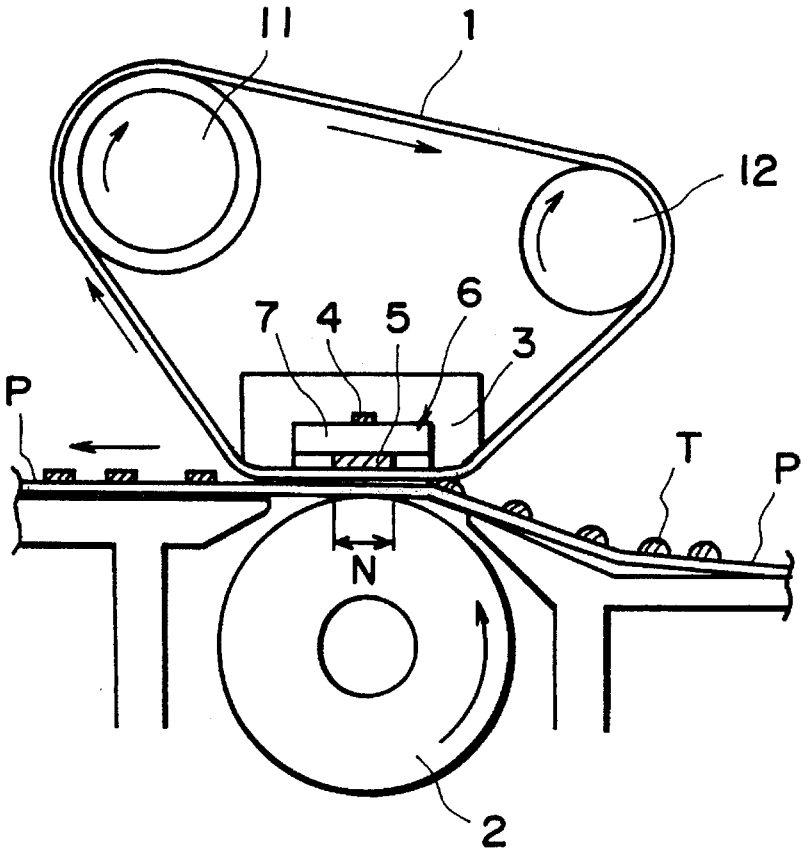
FIG. 2 is a sectional view of the fixing apparatus.
FIG. 3 shows a relationship between an operation starting temperature and a control temperature.

FIG. 2 is an enlarged view of an image fixing apparatus used in the image forming apparatus.

Referring to FIG. 1, the apparatus will be first described.

In this embodiment, the image forming apparatus is a laser beam printer of an image transfer and electrophotographic process type.

Designated by a reference numeral 60 is a process cartridge which contains four process means, namely, a rotatable electrophotographic photosensitive member (drum) 61, a charger 62, a developing device 63 and a cleaning device 64. The process cartridge can be detachably mountable to a predetermined position in the apparatus when a cover 65 of the main apparatus is opened. The process means are controlled by control means including CPU or the like in the main assembly. Upon the image formation start signal, the drum 61 is rotated in the clockwise direction, indicated by an arrow. The surface of the rotating drum 61 is uniformly charged to a predetermined polarity and potential by the charger 62, and the charged surface is exposed to a laser beam 67 from a laser scanner 66. The laser beam 67 has been modulated in accordance with time series electric digital pixel signal corresponding to intended image information (main scan). By this, an electrostatic latent image corresponding to the intended image information is formed on the photosensitive drum 61 surface. The latent image is visualized into a toner image by the developing device 63.

On the other hand, a recording material sheet P in the sheet feeding cassette 68 is fed out one-by-one by cooperation between the sheet feeding roller 69 and a separation pad 70. In synchronism with the rotation of the drum 61, it is fed out to an image transfer nip 73 formed by a transfer roller 72 and the drum 61 by a pair of registration rollers 71. By the transfer roller 72, the toner image is transferred from the drum 61 surface to the surface of the recording sheet P.

The recording sheet P having passed through the transfer station 73 is separated from the surface of the drum 61, and is introduced into the fixing apparatus along a guide 74. The unfixed toner image is heat-fixed and the recording material discharged through an outlet 75 as a print.

The surface of the drum 61 from which the recording material sheet P has been separated, is cleaned by the cleaning device 64, so that the contamination such as residual toner or the like is removed so as to be prepared for the next image forming operation.

FIG. 2 is a sectional view of an image fixing apparatus according to an embodiment of the present invention. Designated by a reference numeral 1 is a fixing film comprising heat resistive resin film base of polyimide or the like coated with a heat resistive parting layer of PFA or PTFE.

Designated by a reference numeral 6 is a heater comprising heat resistive insulative base plate 7 of high thermal conductivity and made of alumina or the like, and a heat generating resistor pattern 5 of silver palladium or the like. On the backside thereof, a temperature sensor 4 is bonded. Designated by a reference numeral 3 is a stay for supporting the heat generating element 6 and is of thermal insulative resin material for guiding sliding motion of the film 1.

Designated by a reference numeral 11 is a driving roller for driving the fixing film 1 at the inside thereof; 12 is a tension roller for preventing lateral shifting of the fixing film 1 by application of tension force. Film 1 is given in the direction indicated by an arrow.

The recording material P carrying the unfixed toner image is heated and pressed by a nip N into a permanent image, and then is discharged therefrom.

The electric power supply to the heat generating element 6 is maintained off during the stand-by state. After production of the image formation signal, the electric energy supply to the heat generating element 6 is started, and the control operation is effected by a fixing temperature control means such that the detected temperature by the temperature sensor is at a predetermined fixing temperature.

After the fixing operation, if another image formation start is not produced, the electric energy supply to the heat generating element 6 is stopped.

The description will be made as to a method (method 1) for determining the control temperature TC on the basis of detected temperature T1 of the temperature detecting element 4 immediately before the start of the operation.

As an example, the temperatures are grouped into three levels with respect to the detected temperature T1, and the different fixing temperature TC are assigned for the respective groups, as shown in FIG. 3.

When the detected temperature T1 is less than 50° C., it is discriminated that the apparatus is in a cold state, and a relatively high fixing temperature 190° C. is selected.

If it is not less than 70° C., it is discriminated that the apparatus is warm, and the fixing temperature of 170° C. is selected.

The description will be made as to the method of determining the fixing temperature during continuous printing operation.

In the continuous printing operation, a plurality of image forming operations are repeated in response to one image formate, on signal. After the image formation, next image formation may be started by production of a next image formation signal. This is called here "intermittent printing operation".

It is desirable that during the continuous printing operation, the fixing temperature is switched depending on the temperature of the apparatus. With the warming of the apparatus, the heat is supplied to the sheet also from the pressing roller. Therefore, in order to maintain constant a total heat applied to the sheet, it is desirable that the controlled temperature at the heater is gradually decreased.

If the heater temperature is not decreased, the sheet is overheated with the result of hot offset.

The method of discrimination of the temperature control switching during the continuous printing, the heater is rendered off during the sheet interval or during the post rotation, and the temperature change dT/dt detected by the temperature sensor is discriminated to determine the warming state of the apparatus, and on the basis of that, the fixing temperature is determined.

Figure 4:
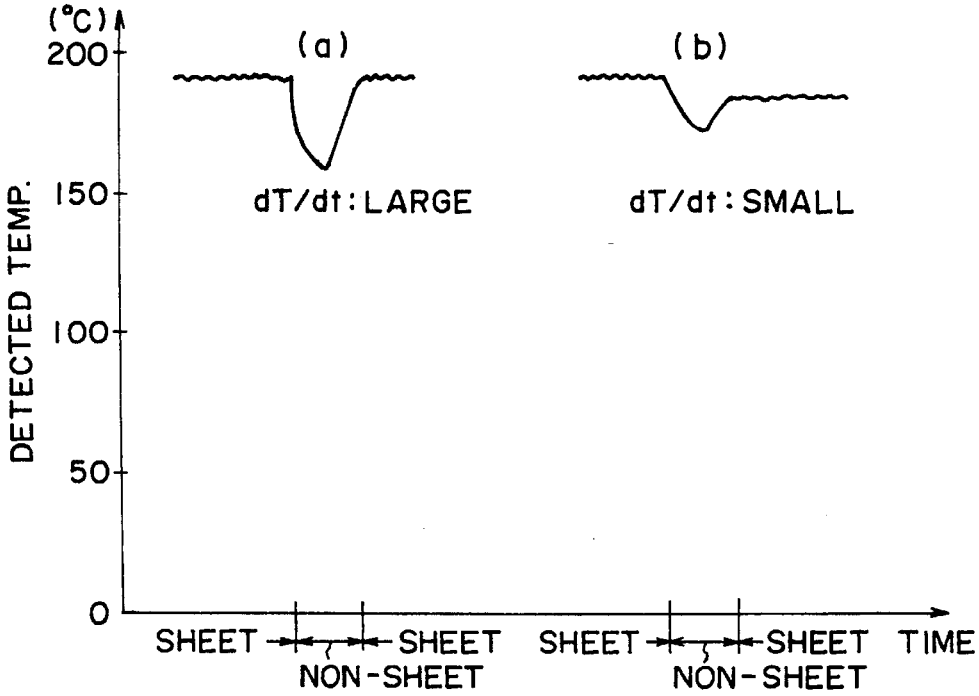
FIG. 4 shows switching of the fixing temperature.

For example, if the apparatus is called as shown in FIG. 4, dT/dt is larger than a predetermined reference level, if the heater is rendered off during the sheet interval as in (a), and therefore, the temperature control is continued with the same target temperature.

On the other hand, if dT/dt is smaller than a reference level as in (b), it is discriminated that the apparatus is warm, and the control temperature is lowered.

Figure 5:
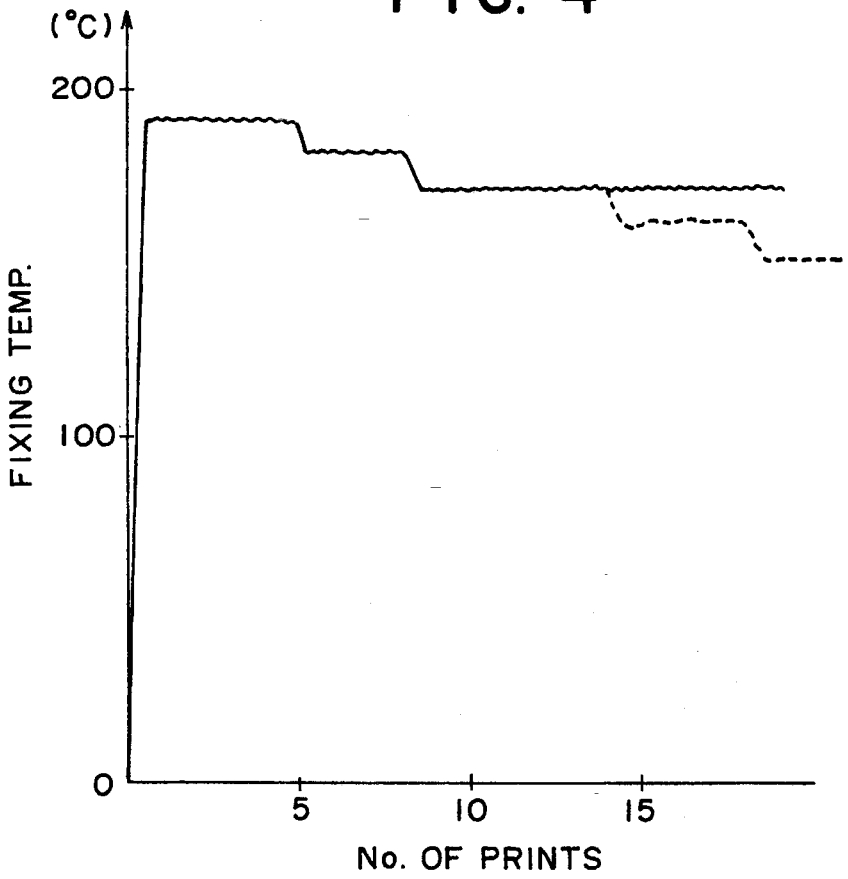
FIG. 5 shows change of the fixing temperature during continuous operation.

By effecting this control, when the continuous printing is carried out as shown in FIG. 5 (solid line), the fixing temperature is gradually lowered. After the fixing temperature during the continuous printing is changed in the manner described above, the printing operation is completed or stopped. At this time, the control temperature T2 at the time of the final printing determined on the basis of the temperature change dT/dt, is stored.

When the printing operation is resumed, the control temperature T2 is used as the fixing temperature. This is called method 2.

In this embodiment, the comparison is made between the two fixing temperatures T1 and T2 determined through the method 1 and 2, respectively, and the higher one is used as the fixing temperature for the resumed printing operation.

Figure 6:
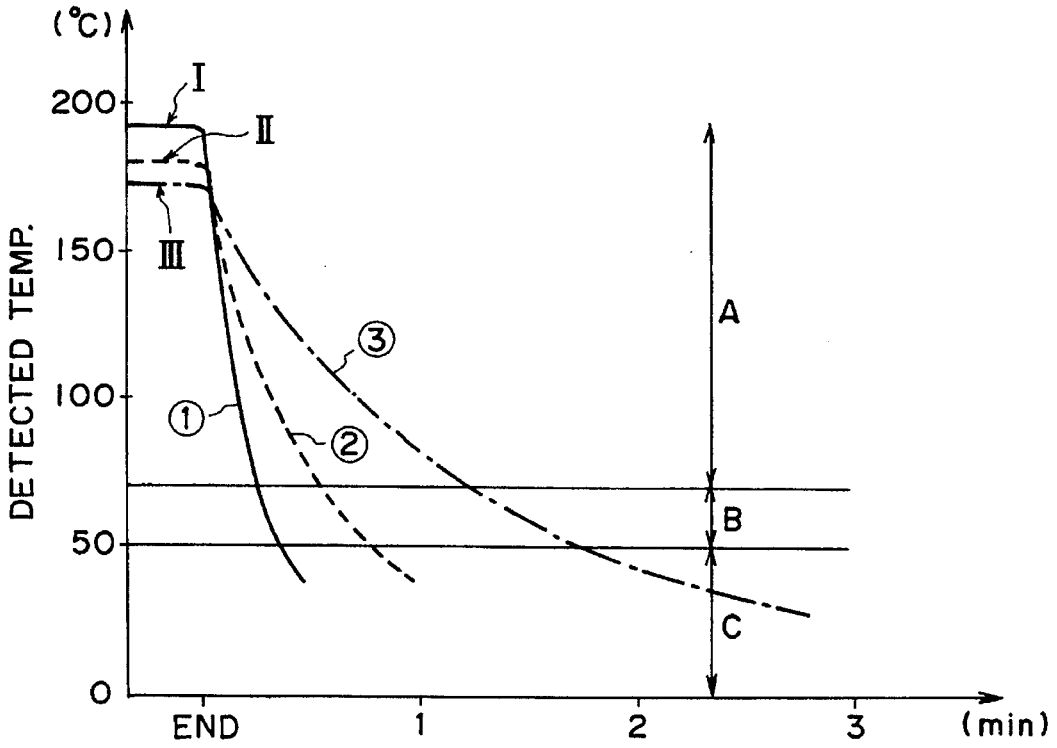
FIG. 6 shows attenuation of temperature after operation end.

Referring to FIG. 6, the detailed description will be made.

When the apparatus is not warm (1), dT/dt upon sheet interval heater-off before print stop is large, and the control temperature is higher (190° C.). In this case, the fixing temperature determined through the method 2 is T2=190° C. The fixing temperature of 190° C. is selected when the printing operation is resumed at any point of time during the heat radiation. Relative to the temperature situation detected by the temperature sensor, the selection of the fixing temperature in this embodiment is as follows.

TABLE 1

| Sensed temp. | Method 1 T1 | Method 2 T2 | Fixing temp. TC = MAX (T1, T2) |
|---|---|---|---|
| ≧70° C. | 170° C. | 190° C. | 190° C. |
| ≧50° C., <70° C. | 180° C. | 190° C. | 190° C. |
| <50° C. | 190° C. | 190° C. | 190° C. |

When the apparatus is called like this, a higher fixing temperature is selected irrespective of the initial heater temperature, by which improper image fixing operation is avoided.

When the fixing apparatus is a little warm, as indicated by broken line (2), T2=180° C. is stored, and the fixing temperature TC during the resumed printing operation in the heat radiating state, is as follows.

TABLE 2

| Sensed temp. | Method 1 T1 | Method 2 T2 | Fixing temp. TC '2 MAX (T1, T2) |
|---|---|---|---|
| ≧70° C. | 170° C. | 180° C. | 180° C. |
| ≧50° C., <70° C. | 180° C. | 180° C. | 180° C. |
| <50° C. | 190° C. | 180° C. | 190° C. |

If the apparatus is warm enough, as shown by chain lines (3), T2=170° C. is stored, and the fixing temperature TC in the resumed printing operation is as follows.

TABLE 3

| Sensed temp. | Method 1 T1 | Method 2 T2 | Fixing temp. TC = MAX (T1, T2) |
|---|---|---|---|
| ≧70° C. | 170° C. | 170° C. | 170° C. |
| ≧50° C., <70° C. | 180° C. | 170° C. | 180° C. |
| <50° C. | 190° C. | 170° C. | 190° C. |

Figure 7:
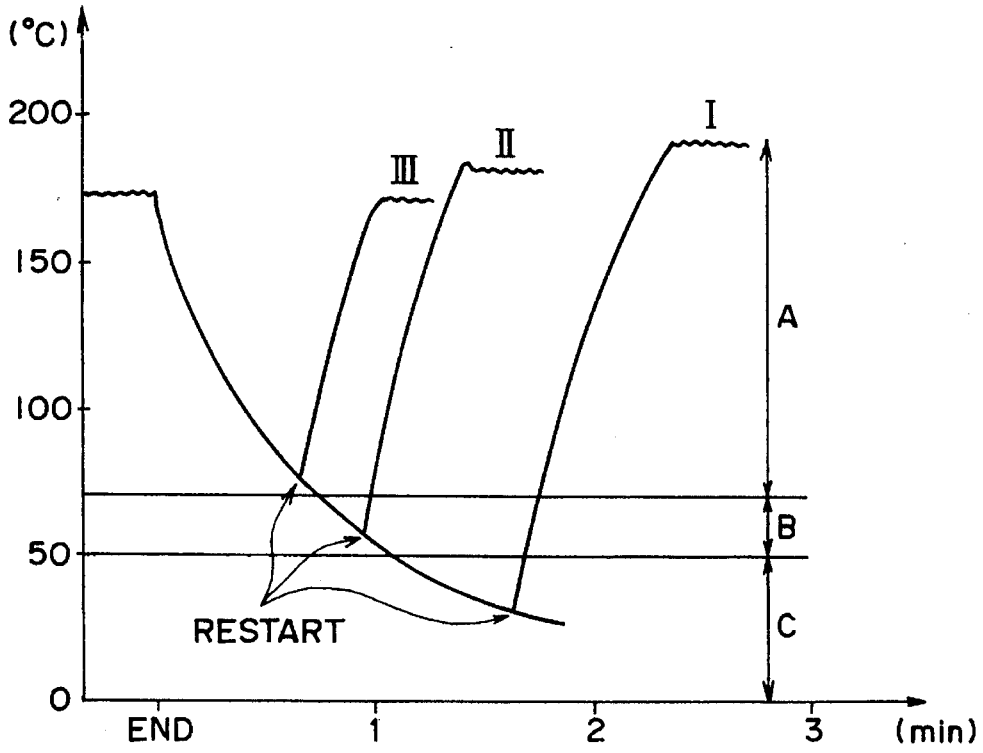
FIG. 7 shows control in the embodiment.

When the control operation is effected as described above, the fixing temperature changes in the manner shown in FIG. 7, depending on the timing of the resuming operation.

More particularly, when the apparatus is warm (A), the low fixing temperature (III) is selected so that the hot offset is prevented. When the apparatus is called (C), a relatively high temperature (I) is selected so that improper image fixing operation is prevented. When the apparatus is in an intermediate temperature state (B), the fixing temperature (II) is selected.

As described above, the warming state of the apparatus is detected by the temperature of the heater and the temperature changing rate, and on the basis of the detection, the fixing temperature is determined, by which both of the improper image fixing operation and occurrence of hot offset can be prevented.

In addition, the above advantageous effects are provided in any printing mode (continuous or intermittent).

In this embodiment, the electric energy supply to the heater during sheet intervals is rendered off, by which the temperature changing rate dT/dt is determined, However, this may be determined by rendering on the heater.

Another example of determining the fixing temperature will be described.

In the foregoing embodiment, the number of fixing temperature levels in the method 1 and the number of fixing temperature levels during the continuous printing, are the same. It is preferable that the number of levels during the continuous printing is larger.

For example, as shown by broken lines in FIG. 5, a temperature level determined by the temperature changing rate is classified into 5 levels, i.e., 190° C., 180° C., 170° C., 160° C. and 150° C., and the temperature detection level in method 1 is determined as follows (Table 4).

TABLE 4

| Level | Sensed temp. | T1 |
|---|---|---|
| D | ≧110° C. | 150° C. |
| A' | ≧70° C., <110° C. | 170° C. |
| B | ≧50° C., <70° C. | 180° C. |
| C | <50° C. | 190° C |

By combining this and the fixing temperature T2, the fixing temperature TC is determined as follows.

TABLE 5

| | Method 1 T1 | Method 2 T2 | Fixing temp. TC = MAX (T1, T2) |
|---|---|---|---|
| D | 150° C. | T2 | T2 (one of 5 levels between 150–190° C.) |
| A' | 170° C. | T2 | 170° C., 180° C. or 190° C. |
| B | 180° C. | T2 | 180° C. or 190° C. |
| C | 190° C. | T2 | 190° C. |

Figure 8:
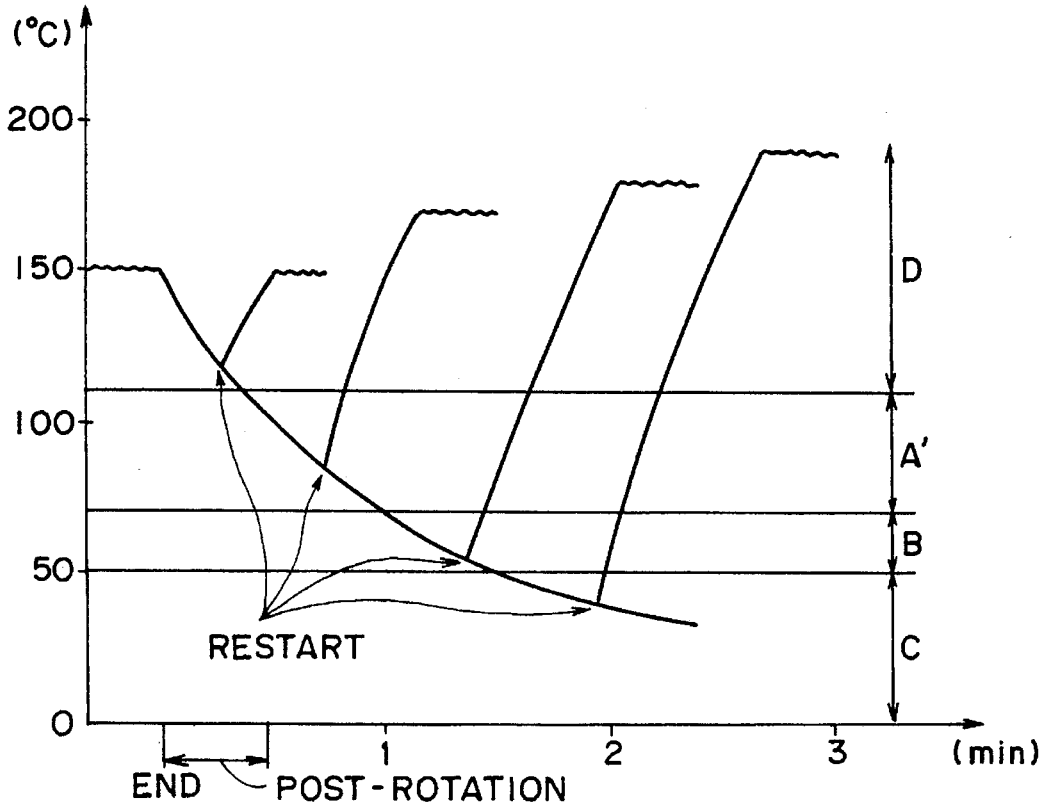
FIG. 8 shows control according to another embodiment.

For example, the fixing temperature immediately before the resumed printing is 150° C., the fixing temperature in the resumed printing operation is as shown in a graph of FIG. 8 depending on the time period elapsed to the start of the reprinting.

In the case of the intermittent printing, it is usual that after the completion of the image forming operation, a post rotation is effected, and the apparatus is placed in a stand-by state until the next image formation signal is supplied. In other words, a relatively long period exist between adjacent printing operations. In the foregoing embodiment, the cooling occurs during this period, and the fixing temperature upon the start of the reprinting operation does not lower depending on the fixing temperature in the printing operation immediately before.

In other words, in the foregoing embodiment, if the printing operation immediately before the resumed printing operation ends with 170° C., then 170° C.–190° C. is selected as the fixing temperature for the resumed printing. However, when the resumed printing starts simultaneously with the stop of the print, the heat may be excessive even if 170° C. is selected. For example, this occurs when the printing is resumed during the post-rotation period after the previous printing is completed. In this case, a slight degree of hot offset may occur in the foregoing embodiment.

In another embodiment, a fixing temperature T2 determined through the method 2 using more finely divided levels is used as the fixing temperature TC. By doing so, in the present embodiment, the temperature is lower than the temperature determined by T1, and therefore, the hot offset can be completely avoided.

The description will be made as to the sheet feeding interval to the fixing apparatus.

The sheet feed to the fixing apparatus is such that the recording material having received the image is supplied as it is into the fixing device. Therefore, the sheet feeding timing to the fixing apparatus is the same as the image formation timing.

Therefore, the sheet feeding interval to the fixing apparatus is controlled by the image formation interval. Therefore, means for controlling the timing of the image forming operation functions as the sheet feed interval control means for the recording material into the fixing apparatus, In this embodiment, when a high fixing temperature is selected, the apparatus is in the cold state, and the temperature rise in the sheet non-passage area does not occur.

Then, the continuous printing is carried out with short sheet intervals.

When the fixing temperature is changed to a lower temperature during the continuous printing operation, it means that the apparatus is warm, and the temperature increase in the sheet non-passage area occurs depending on the temperature of the apparatus.

In this embodiment, when the fixing temperature is lowered, the continuous printing operation is carried out with longer sheet intervals.

More particularly, in the case that small size sheets are used, the sheet feed intervals are expanded when the minimum fixing control temperature is reached.

For example, when the heater control temperature is classified into 5 levels, that is, 190° C., 180° C., 170° C., 163° C. and 155° C., the temperature of the pressing roller is not very hot in the range of 190° C., 180° C., 170° C. and 163° C., even if small size sheets are supplied. Therefore, the temperature difference between the sheet passage area and the sheet non-passage area is not so significant as to damage the film, and therefore, no problem arises even if the sheet interval is not expanded.

Rather, from the standpoint of efficiency of larger number of prints per unit time, it is desirable that the sheet feed interval is not expanded.

About 15–20 printing operations are carried out. In the case of small capacity users, the operation is completed within this range, and therefore, the efficient operation is possible without expanding the sheet feed intervals.

When 20 or more sheets are processed, and the minimum temperature 155° C. is selected, the sheet feed intervals are expanded in this embodiment, so that twisting of the fixing film or tearing thereof can be avoided.

As described in the foregoing, in this embodiment, when the fixing temperature is lowered, the sheet feed intervals is expanded, and therefore, the heat transfer between the sheet non-passage area and the sheet passage area can be carried out sufficiently during the sheet intervals, and therefore, the temperature increase in the sheet non-passage area can be assuredly avoided, thus preventing twisting or tearing of the film beforehand. At this time, the fixing temperature is low, and therefore, it is effective from the standpoint of the temperature increase in the sheet non-passage area.

Small size sheet means a sheet having a width (measured in a direction perpendicular to the sheet feeding direction) which is smaller than a maximum fixable width.

Large size sheets are those which have a width corresponding to the maximum fixable width, and these are fed at intervals which do not change.

The description will be made as experiments of the embodiments of the invention and comparison example.

EXAMPLE

The fixing film comprises a cylindrical film of polyimide having a thickness of 60 μn and a parting layer of Teflon having a thickness of 10 μm bonded on the film surface with a bonding material of 4 μm. The ceramic heater comprises an alumina base material having a width of 9 mm, a length of 262 mm and a thickness of 0.63 mm. On this, a heat generating resistor of silver palladium is printed into a line. The total resistance thereof is 28.3 Ω. The pressing roller comprises a core metal of 10 mm and a silicone rubber or 3 mm-thick therearound.

With this structure, in the initial stage of the printing operation, the sheets are fed at a rate of 3.4 per minute (A4 sheet). Simultaneously with reducing the control temperature to the minimum temperature 155° C., the sheet feed interval is expanded to 2.5 sheets per minute. As a result, the twisting or tearing of the fixing film could be avoided.

COMPARISON EXAMPLE

The sheet feed interval is not expanded. Even if 155° C. is reached, the rate of 3.5 sheet per minute is maintained. Then, the fixing film is twisted at 25th sheet, and at 50th sheet, the film lateral end is shifted toward the center, with the result that the heater directly contacted to the pressing roller or the recording sheet.

As will be understood, the problem capable of resulting in the tearing of the film fixing device can be avoided.

In the case that the apparatus has two modes, namely, cassette feeding mode and manual feeding mode, the control temperature may be switched in the similar manner, but the sheet interval may be controlled only for the manual feeding mode.

The reason is as follows. In the case of cassette feeding, wide sheets are used such as A4, B5, letter size or the like, and therefore, the temperature difference between the sheet non-passage region and the sheet passage region does not tend to occur, and therefore, the twisting or tearing of the fixing film does not easily result. Therefore, in the case of the cassette feeding mode, the sheet feed interval may be reduced to increase the efficiency.

In the case of the manual feeding mode, it is frequent that envelope or post card are used, which have small width. In this case, the temperature difference between the sheet non-passage region and the sheet passage region easily occurs. Therefore, the twisting or tearing of the fixing film tends to occur. By effecting the sheet interval expanding control, the difference of the thermal expansions of the pressing roller can be suppressed to a low degree, thus avoiding the problem.

More particularly, in the cassette sheet feeding mode, A4 sheet is fed at a constant rate, for example, 4 sheets per minute. In the manual feeding mode, the feeding rate is 3.4 sheets per minute at the initial stage, and the rate is switched to 2.5 per minute after 155° C. temperature control is reached. When this is carried out, it has been confirmed that the efficient printing operations are possible without damage of the firing film.

In the above-described embodiment the sheet interval is switched between two levels, but the number of levels may be increased.

Figure 9:
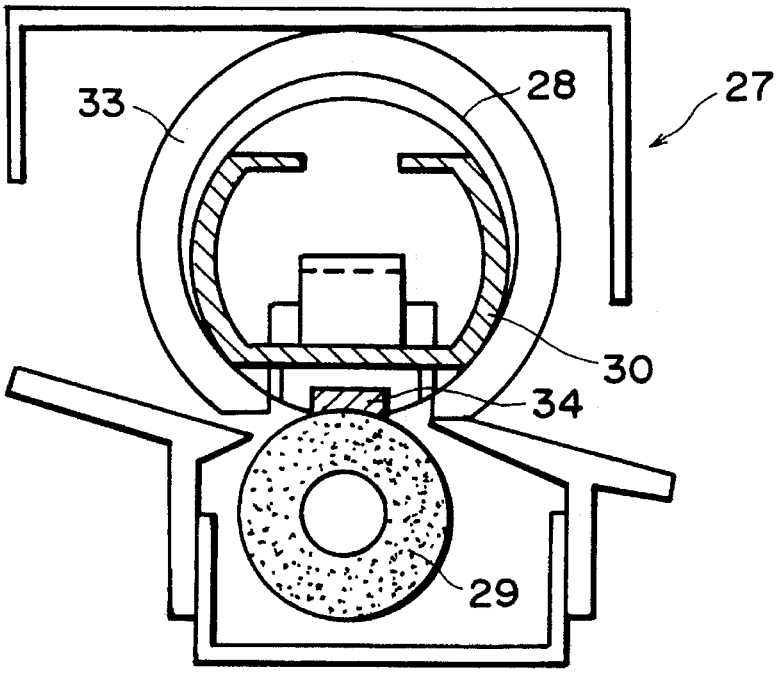
FIG. 9 is a sectional view of an image fixing apparatus according to a further embodiment.
Figure 10:
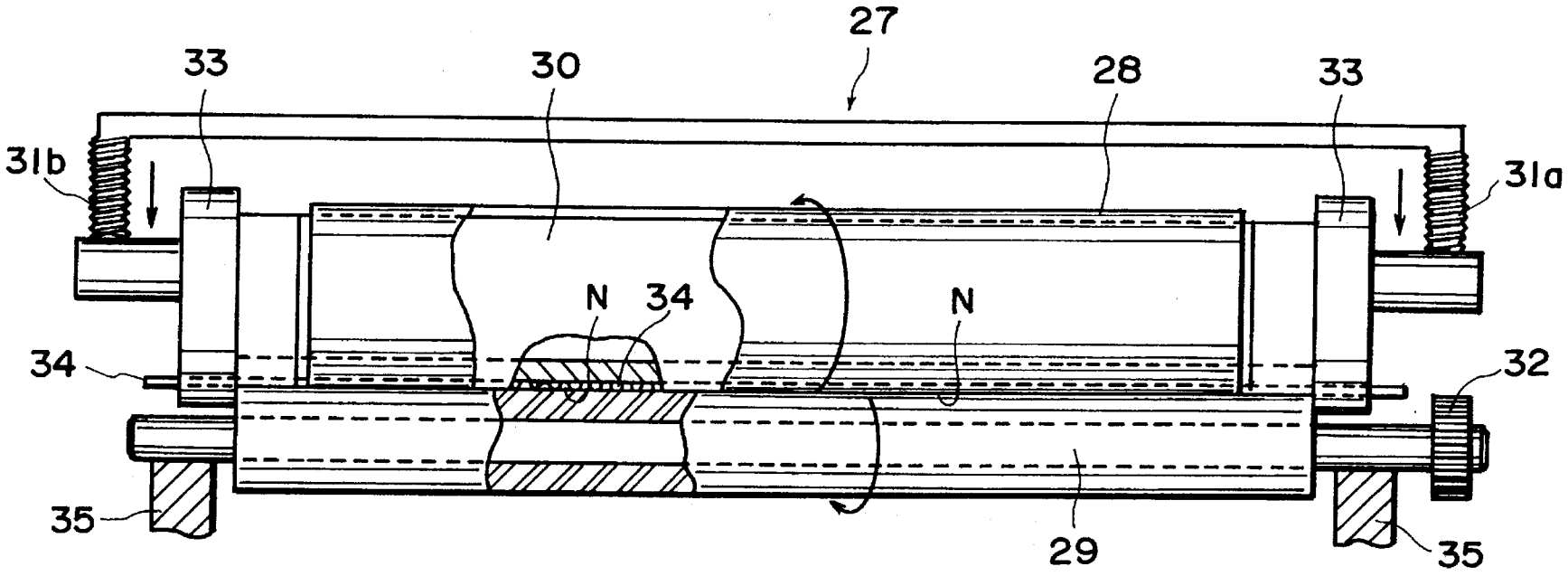
FIG. 10 is a view as seen from heat discharging side, of the apparatus of FIG. 9.
Figure 11:
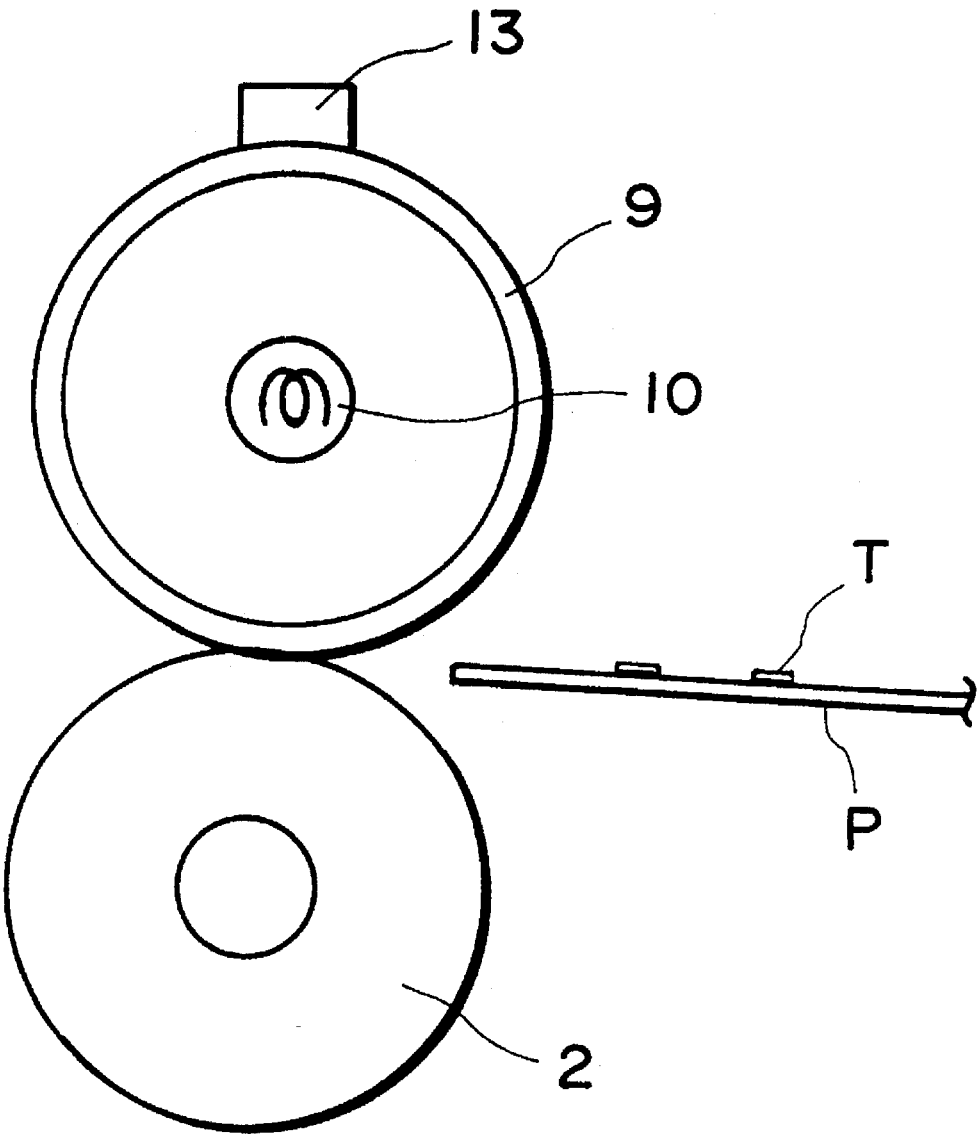
FIG. 11 PRIOR ART
FIG. 11 shows a roller heating apparatus of prior art.

Referring to FIGS. 9 and 10, an image fixing apparatus in which the present invention is further effective, will be described.

FIG. 9 is a sectional view, and FIG. 10 is a view as seen from a sheet discharging side. As shown in FIGS. 9 and 10, the fixing film 28 is a single layer fixing film having a heat resistivity, toner parting property and toughness, or a compound film subjected to a desired surface treatment or laminate treatment. For example, the single layer film may be of polyester (PET) or polyimide (PI) having a thickness of approx. 50 μm, for example, having been subjected to heat-resistant treatment. Or, it may be a compound film comprising the above film and treated for the parting property with tetrafluoroethylene (PTFE). In the fixing device 27, the fixing film is an endless cylindrical form, and no tension is applied in the circumferential direction except for the nip portion, and the film is rotated only by the friction with the pressing roller 29.

The heater 34 contacted to the fixing film guide for supporting the inside of the fixing film 28 along the length thereof and the pressing roller are press-contacted by pressure springs 31*a* and 31*b* with the fixing film 28 therebetween, at a predetermined pressure (total pressure of 3–6 kg for A4 width, for example). At the surface of the heater 34, there is a thin film heat generating resistor in the form of a line or stripe of $TaSiO_2$, silver palladium, $Ta_2N$, $RuO_2$, nickel-chromium, formed through evaporation, sputtering, CVD or screen printing process. An end of the fixing film is limited by a flange 33 mounted to the film guide 36 at the time of the manufacturing of the apparatus, so that the lateral shifting of the fixing film during the drive of the heat fixing apparatus 27, can be regulated.

The transfer sheet P having received the unfixed toner image is supplied into the fixing nip together with the fixing film 28 by the surface friction of the pressing roller rotated by a driving gear 32, and then, at least in the fixing nip, is moved at the same speed as the fixing film 28 and the pressing roller 29 without slippage by the contact pressure provided by the springs 31*a* and 31*b*. Designated by reference numeral 35 is a bearing for the pressing roller 29. After passing through the fixing nip, the fixing film 28 and the transfer sheet P continue to be fed because of the adhesive force of the fused or softened toner T. The feeding step is used as a cooling step in which the heat is radiated from the softened or fused toner T, so that the toner T is cooled and solidified into a permanent image on the transfer sheet P. After the cooling step, the fixing film 18 and the transfer sheet P is easily separated because the toner is cooled and solidified. After the separation, the transfer sheet P is discharged from the heating apparatus 27.

In this apparatus, the fixing temperature control and the sheet interval control as described with the foregoing embodiments, are carried out.

In the case of the pressing roller used as the driving roller as in this embodiment, the temperature rise of the non-sheet passage area directly influences the driving roller, and therefore, the twisting or lateral shifting of the film due to deformation of the driving roller is more significant. However, according to this embodiment, the sheet non-passage area temperature rise can be suppressed to avoid the problem. The present invention is particularly effective in the case of the pressing roller used as the driving roller.

When the lateral end of the film is received by the flange, the film end is damage if the lateral shifting force is large, and therefore, the change of the sheet feed interval depending on the fixing temperature is very effective.

In the foregoing embodiment, the fixing temperature is determined using methods 1 and 2, but only one of them may be used to determine the fixing temperature.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus comprising:

a heating member for heating an unfixed image carried on a recording material; and fixing temperature control means for controlling a temperature of said heating member at a target temperature which is variable;

wherein when the target temperature is lowered, an interval of recording material supply to said heating member is increased.

2. An apparatus according to claim 1, further comprising a temperature sensor for sensing a temperature of said heating member, wherein said target temperature is determined by said fixing temperature control means on the basis of a temperature detected by said temperature sensor.

3. An apparatus according to claim 2, wherein the target temperature is determined in accordance with change with time of the detected temperature by said temperature sensor.

4. An apparatus according to claim 1, further comprising a temperature sensor for detecting a temperature of said heater, wherein a current target temperature is determined on the basis of a comparison between a value on the basis of a sensed temperature of said temperature sensor and a fixing temperature at an end of previous fixing operation.

5. An apparatus according to claim 1, wherein change of said target temperature is effected while continuous fixing operations are carried out when recording materials are continuously fixed.

6. An apparatus according to claim 5, wherein when the number of continuous fixing operations reaches a predetermined number, the target temperature is changed.

7. An apparatus according to claim 5, wherein in a continuous fixing, a plurality of fixing operations are carried out in response to one instruction signal.

8. An apparatus according to claim 1, wherein the interval is increased when the target temperature is changed to a lowest predetermined temperature.

9. An apparatus according to claim 1, wherein when a smaller width recording material is fixed, the interval is increased.

10. An apparatus according to claim 9, wherein the interval is not changed, when large size recording materials are fixed.

11. An apparatus according to claim 1, further comprising a film in sliding contact with said heater, and a pressing member for forming a nip in cooperation with said heating member with the film therebetween.

12. An image fixing apparatus comprising:

a heating member for fixing an unfixed image on a recording material; and fixing temperature control means for providing a variable fixing temperature of said heating member;

wherein said apparatus is capable of effecting its fixing operation on a first size recording material having a width corresponding to a maximum fixable width of said apparatus, and a second size recording material having a width smaller than that of said first size recording material; and wherein when second size recording materials are continuously fixed and continuous fixing operation reach a predetermined number, the fixing temperature is lowered while the recording materials are continuously fixed.

13. An apparatus according to claim 12, wherein in a continuous fixing, a plurality of fixing operations are carried out in response to one instruction signal.

ST AVAILABLE COPY

ST AVAILABLE COPY

14. An apparatus according to claim 12, further comprising a film in sliding contact with said heater, and a pressing member for forming a nip in cooperation with said heating member with the film therebetween.

15. An image fixing apparatus comprising:

a heating member for fixing an unfixed image on a recording material;

fixing temperature control means for providing a variable fixing temperature of said heating member;

wherein said apparatus is capable of effecting its fixing operation on a first size recording material having a width corresponding to a maximum fixable width of said apparatus, and a second size recording material having a width smaller than that of said first size recording material;

wherein when second size recording materials are continuously fixed, a recording material feeding interval is increased while the recording materials are continuously fixed, whereas the interval is not changed when the first size recording materials are fixed.

16. An apparatus according to claim 15, wherein number of continuous fixing operations reaches a predetermined number, the interval is changed.

17. An apparatus according to claim 15, wherein in a continuous fixing, a plurality of fixing operations are carried out in response to one instruction signal.

18. An apparatus according to claim 15, further comprising a film in sliding contact with said heater, and a pressing member for forming a nip in cooperation with said heating member with the film therebetween.

19. An image fixing apparatus comprising:

a heating member for heating an unfixed image carried on a recording material; and fixing temperature control means for providing a variable fixing temperature of said heating member;

wherein said apparatus is capable of effecting its fixing operation on a first size recording material having a width corresponding to a maximum fixable width of said apparatus, and a second size recording material having a width smaller than that of said first size recording material; and wherein when recording materials are continuously fixed, an interval of recording material supply to said heating member and the fixing temperature of said fixing temperature control means are changed while the recording materials are continuously fixed, whereas the interval is not changed when recording materials of the first size are fixed.

20. An apparatus according to claim 19, wherein in a continuous fixing, a plurality of fixing operations are carried out in response to one instruction signal.

21. An apparatus according to claim 19, further comprising a film in sliding contact with said heater, and a pressing member for forming a nip in cooperation with said heating member with the film therebetween.

* * * * *

UNITED STATES PATENT AND TRADEMARK OFFICE

CERTIFICATE OF CORRECTION

PATENT NO. : 5,552,874
DATED : September 3, 1996
INVENTOR(S) : YASUMASA OHTSUKA, ET AL.

It is certified that error appears in the above-indentified patent and that said Letters Patent is hereby corrected as shown below:

Column 1,
line 24, "reaches to" should read --to reach--.
Column 2,
line 11, "yet" should read --yet a--.
Column 4,
line 14, "formate, on" should read --formation--.
Column 5,
Table 2, "TC '2 MAX" should read --TC = MAX--.
Column 7,
line 45, "intervals is" should read --intervals are--;
line 60, "as" should read --of--; and
line 66, "60μn" should read --60μm--.
Column 8,
line 55, "firing" should read --fixing--.
Column 10,
line 61, "operation" should read --operations--.
Column 11,
line 7, "material;" should read --material; and--; and
line 21, "wherein" should read --wherein when the--.

Signed and Sealed this
Twenty-eighth Day of January, 1997

*Attest:*

Bruce Lehman

BRUCE LEHMAN

*Attesting Officer* *Commissioner of Patents and Trademarks*